United States Patent [19]

Winters, Michael P.

[11] Patent Number: 4,867,453

[45] Date of Patent: Sep. 19, 1989

[54] GOLF CLUB GRIP

[76] Inventor: Winters, Michael P., 505 South Burnett, Baytown, Tex. 77520

[21] Appl. No.: 182,946

[22] Filed: Apr. 18, 1988

[51] Int. Cl.[4] ..... A63B 53/14

[52] U.S. Cl. ..... 273/81.4; 273/164

[58] Field of Search ..... 273/81 R, 81 B, 81.4, 273/81.5, 81.6, 81.3, 163 R, 163 A, 164, 75, 81 D, 67 DA, 29 A, 193 R, 194 R, 186 C, 165, 73 J; D21/222; D8/DIG. 6, DIG. 5; 81/177.1, 489; 16/110 R

[56] References Cited

U.S. PATENT DOCUMENTS

| | | | |
|---|---|---|---|
| 1,291,464 | 1/1919 | Folliard | 273/81 B |
| 1,638,454 | 8/1927 | Papin | 273/81.4 |
| 2,628,100 | 3/1953 | Beebe | 273/81.4 |
| 4,376,536 | 3/1983 | Martin | 273/81.4 |
| 4,664,381 | 5/1987 | Aaron | 273/75 |

FOREIGN PATENT DOCUMENTS

| | | | |
|---|---|---|---|
| 2928995 | 4/1981 | Fed. Rep. of Germany | 273/75 |

*Primary Examiner*—Edward M. Coven
*Assistant Examiner*—S. Passaniti
*Attorney, Agent, or Firm*—Browning, Bushman, Zamecki & Anderson

[57] ABSTRACT

A golf club having a head, a shaft and a grip, the grip being provided with a shoulder which forms an abutment surface against the outer surface of the little finger of the upper hand of the user using a conventional golf grip, the abutment surface being substantially planar and being angled relative to an axis passing longitudinally through the grip and the shaft to accommodate the normal positioning of the little finger of the user.

2 Claims, 1 Drawing Sheet

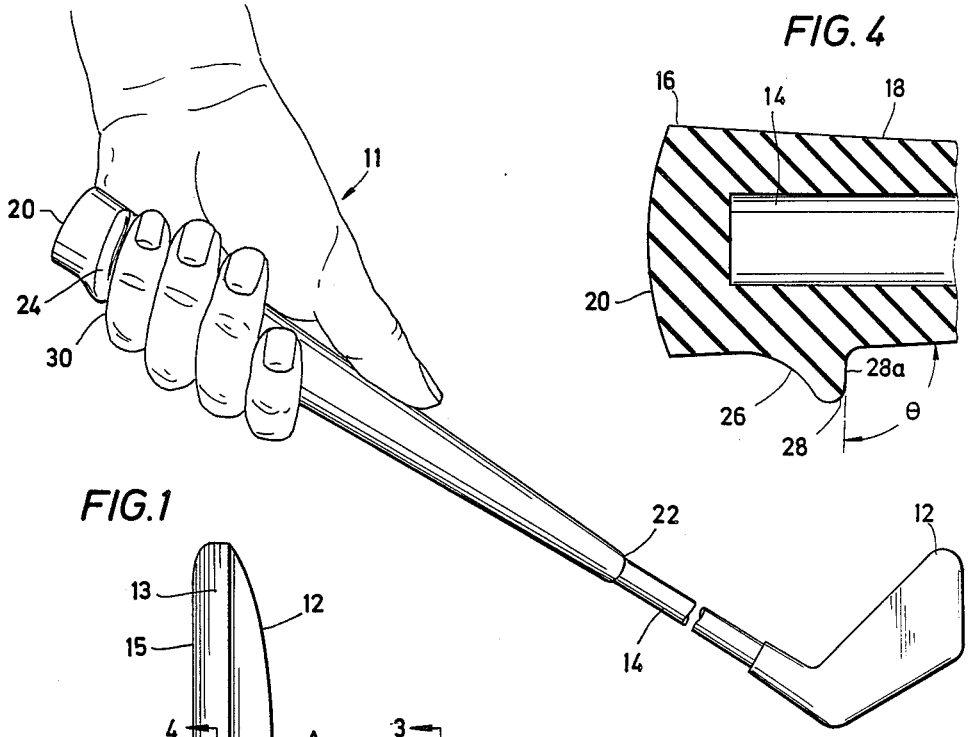
FIG. 4
FIG. 1
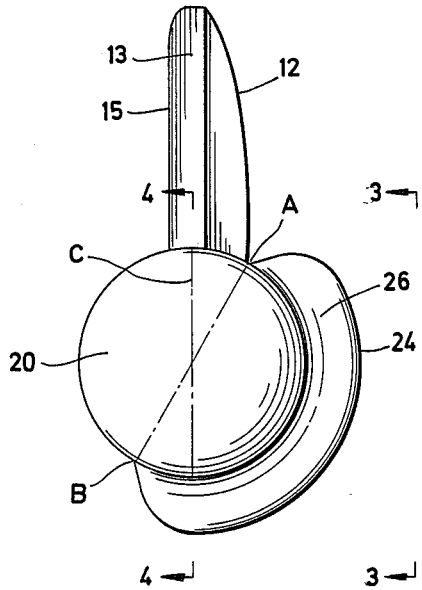
FIG. 2
FIG. 3
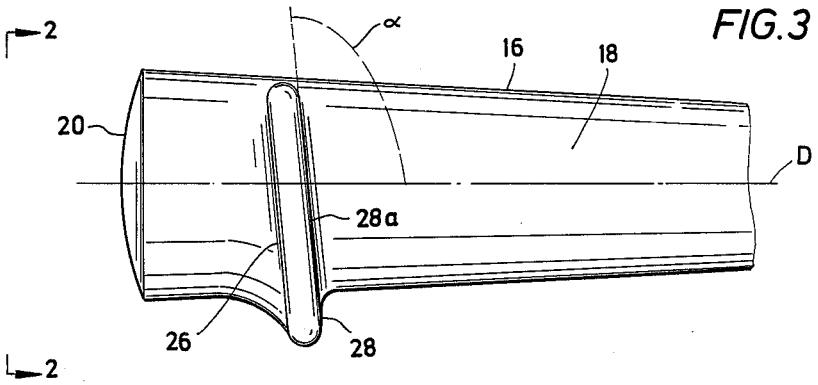

GOLF CLUB GRIP

BACKGROUND OF THE INVENTION

1. Field of the Invention

The present invention relates to golf clubs and, more particularly, to a golf club having an improved grip for enabling the user to generate maximum club head speed.

2. Description of the Prior Art

As is well known to those skilled in the art, large centrifugal forces are generated during the normal swing of a golf club. Indeed, the forces are so large that in many cases, the club will slip from the grip of the user resulting in a bad golf shot at best and potential injury to a bystander at worst. To overcome this problem, in certain instances the grip has been enlarged immediately adjacent the end to prevent or at least minimize slippage of the club during the swing.

In U.S. Pat. No. 4,376,536 there is disclosed a golf grip which has a button-hook style boss at the end of the grip, the boss forming a curved crotch against which the little finger of the user's upper hand is seated. However, the crotch of the grip may confine the little finger too tightly depending on the size of the hands of the user. Furthermore, the generally U-shaped crotch tends to create pressure on the little finger of the user which is believed to inhibit the swing such that maximum club head speed is not achieved.

U.S. Pat. No. 1,669,340 discloses a golf grip as having a removable ferrule which forms a stop adjacent the upper end of the grip to prevent slippage of the club out of the user's hands during the swing.

SUMMARY OF THE INVENTION

It is therefore and object of the present invention to provide a golf club having an improved grip.

Another object of the present invention is to provide a golf grip for a golf club which minimizes slippage of the club in the user's hands during the swing, and which enables the user to generate maximum club head speed during the swing.

The above and other objects of the present invention will become apparent from the drawings, the description given herein, and the appended claims.

The golf club of the present invention comprises a head, a shaft and a grip, the head being affixed, in conventional manner, to the shaft at one end and the grip being affixable to the shaft at the other end. The grip has an outer surface, a first end and a second end, the first end of the grip being distal the head of the club relative to the second end of the grip. The grip includes an abutment means which projects laterally outwardly from the outer surface of the grip, the abutment means being disposed proximate or closely adjacent the first end of the grip. The abutment means has a first side which is proximate the first end of the grip and a second side which defines a substantially planar abutment surface, the abutment surface forming an angle of approximately 90° or greater with the outer surface of the grip. The abutment surface is positioned on the grip so as to be engageable, at least partially, by the outer side of the little finger of the user and is angled relative to an axis passing longitudinally through the shaft and the grip to accommodate the normal positioning of the little finger of the user on the grip.

BRIEF DESCRIPTION OF THE DRAWINGS

FIG. 1 is a perspective view of the golf club of the present invention showing the position of the upper hand of a user on the grip.

FIG. 2 is an end view taken along the line 2—2 of FIG. 3.

FIG. 3 is an enlarged, fragmentary view of the golf grip of the golf club shown in FIG. 1.

FIG. 4 is a fragmentary view, partly in section, taken along the line 4—4 of FIG. 2.

DESCRIPTION OF THE PREFERRED EMBODIMENTS

Referring first to FIG. 1, a golf club, shown generally as 10, is seen to have a head 12, a shaft 14 and a grip 16, head 12 being connected to shaft 14 at one end thereof, grip 16 being affixed to the other end of shaft 14. Grip 16 has an outer surface 18, a first end 20 and a second end 22, the first end 20 being furthest from or distal head 12 relative to second end 22.

The golf club 10 is generally conventional in all respects with the exception of the configuration of a portion of the grip 16. As best seen with reference to Fig. 3, the grip 16 is provided with a shoulder or projection which extends laterally outwardly from the surface 18 of grip 16 and forms an abutment 24 proximate end 20. Abutment 24 (see FIG. 4) has a first side 26 and a second side 28, first side 26 being proximate end 20 of grip 16. The second side 28 defines an abutment surface, **28*a* which, as best seen in FIG. 4, is substantially flat or planar and forms and angle $\theta$ with the outer surface 18 of grip 16 of about 90° or greater. As best seen with reference to FIG. 1, abutment 24 is positioned on club 10 so as to be engageable, at least partially, by the outer side 30 of the little finger of the upper hand H of a user. Generally, the abutment surface 28*a* extends circumferentially around grip 18 for approximately 180° i.e. approximately half way around grip 18. This enables a substantial portion of the outer side of the little finger of the user to engage the abutment surface 28*a* when the club is properly gripped and during the swing of the club 10. At minimum, the abutment 24 extends for a sufficient circumferential length to ensure that the abutment surface 28*a* spans the joint of the little finger adjacent the end thereof, the abutment surface 28*a*** preferably extending sufficiently to engage a substantial portion of the outer side of the little finger of the hand H of the user between the end of the little finger and the first joint.

As best seen with reference to FIG. 2, abutment 24 is preferably positioned on grip 16 such that it extends from a point A to a point B on the surface 18 of grip 16, points A and B lying in a plane which passes axially through grip 18 and shaft 14 and which is rotated clockwise approximately 30° from a plane C passing through grip 16 and shaft 14 and through head 12 such that the plane C would intersect the face 13 of the head 12 and form an imaginary line therethrough which is generally parallel to the face of the head 12 and the lower edge 15 thereof. This positioning of abutment 24 also aids the user in grasping the club 10 in such a manner that the golf ball will be properly addressed by the head 12 at the commencement of the swing. It is not necessary that the abutment 24 extend for the full distance shown in FIG. 2, i.e. approximately half the circumferential distance around the grip 16. However, it is necessary that abutment 24 extend sufficiently to provide an abutment surface 28*a* which will engage the outer side of the little finger of the upper hand of the user from a point near the end of the little finger to a point past the first joint proximate the end of the little finger, preferably to a point past the second joint distal the end of the little finger.

With particular reference to FIG. 3, it can be seen that abutment surface 28*a* is angled relative to an axis D which passes longitudinally and concentrically through grip 16 and shaft 14, the angling being sufficient to accommodate the normal positioning of the little finger of the upper hand of the user on the grip 16. In the embodiment shown in the Figures, the club is for a right-handed user and accordingly, the surface 28*a* is angled such that the distance between the first end 20 and surface 28*a* decreases as the surface is traversed in a counter-clockwise fashion as viewed from the end 20 of grip 16. It will be appreciated that in the case of a left-handed golfer, the angling of the surface 28*a* relative to the axis D would be reversed. As noted, the angle between the surface 28*a* and the axis D is such as to accommodate the normal positioning of the little finger of the user of the upper hand on the grip. Generally speaking, this angle which is shown as $\alpha$ will be from about 90° to about 97°. Viewed in another way, the angle between the abutment surface 28*a* and a plane perpendicular to axis D will be from about 2 to about 8°.

As can seen with reference to FIG. 1, and when using the improved grip of the present invention, the upper hand H of the user, in this case the left hand, would grasp the grip 16 in the conventional manner such that the outer surface or side 30 of the little finger of the upper hand H would abut the surface 28*a* as shown. The user would then grasp the grip 16 with the other hand in one of the conventional grips such as shown for example, by the Encyclopedia Britanica (1968) under the topical heading "GOLF".

As best seen with reference to FIG. 4, the grip 16 which receives the shaft 14 as a core, can be made of a resilient material such as rubber, leather or various composite materials. The grip 16 can be prefitted to the shaft at the factory. Alternately, grips made to the user's specification can be retrofitted to the shaft 14 as desired.

The golf club grip of the present invention has many advantages over prior art grips designed to prevent slippage of the club from the user's hand. The abutment surface 28*a* does not confine the little finger of the user in uncomfortable fashion. For example, in prior art grips such as shown in U.S. Pat. No. 4,376,536, the little finger of the user, depending upon the hand size, could fit very tightly possibly causing injury as the user followed through on the golf swing. Accordingly, to alleviate this problem, it is necessary that the grip as shown in that patent be individually sized to the user. Moreover, it is the inventor's belief that the crotch-like grip on the little finger may impede the user's ability to generate maximum club head speed necessary to achieve maximum distance. The grip of the present invention accommodates the natural positioning of the user's little finger on the grip and serves not only to prevent slippage of the club from the user's hand during the swing but ensures that the user's hands can go through the proper roll at the finish of the swing without the chance of injury to the little finger of the user.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A golf club comprising a head, a shaft and a grip, said head having a face and being affixed to said shaft at one end thereof and said grip being fixable to said shaft at the other end thereof, said grip having an outer surface, a first end and a second end, said first end being distal said head relative to said second end, said grip including abutment means projecting laterally outwardly from said outer surface of said grip, said abutment means and said grip being formed of a monolithic structure, said abutment means being disposed proximate said first end of said grip, said abutment means having a first side and a second side, said first side being disposed proximate said first end, said second side defining an abutment surface, said abutment means extending from a first point to a second point on said grip, said first and second points lying in a first plane passing through said grip, an angle of about 30° being formed between said first plane and a second plane passing through said grip, said shaft and said head, said second plane intersecting and forming an imaginary line through said head which is generally parallel to the face of said head, said abutment surface being substantially planar and forming an angle of about 90° or greater with said outer surface of said grip, said abutment surface being positioned on said grip so as to be engageable, at least partially, by the outer side of the little finger of a user, said abutment surface being angled relative to an axis passing longitudinally through said grip and said shaft to accommodate the normal positioning of said little finger of said user on said grip.

2. The golf club of claim 1 wherein said abutment surface extends for approximately half the circumferential distance around said grip.

* * * * *